US007009603B2

(12) United States Patent
Page et al.

(10) Patent No.: US 7,009,603 B2
(45) Date of Patent: Mar. 7, 2006

(54) METHOD AND APPARATUS FOR DRIVING LIGHT EMITTING POLYMER DISPLAYS

(75) Inventors: Rich Page, Mountain View, CA (US); Barry Thompson, Menlo Park, CA (US); Dave Mietus, Phoenix, AZ (US)

(73) Assignee: TDK Semiconductor, Corp., Irvine, CA (US)

( * ) Notice: Subject to any disclaimer, the term of this patent is extended or adjusted under 35 U.S.C. 154(b) by 376 days.

(21) Appl. No.: 10/259,234

(22) Filed: Sep. 27, 2002

(65) Prior Publication Data

US 2004/0061672 A1 Apr. 1, 2004

(51) Int. Cl.
*G09G 5/00* (2006.01)

(52) U.S. Cl. ..... 345/211; 345/82

(58) Field of Classification Search ..... 345/82, 345/211

See application file for complete search history.

(56) References Cited

U.S. PATENT DOCUMENTS

| | | | | |
|---|---|---|---|---|
| 5,684,368 | A * | 11/1997 | Wei et al. | 315/302 |
| 6,335,713 | B1 | 1/2002 | Imai | |
| 6,369,786 | B1 * | 4/2002 | Suzuki | 345/77 |
| 6,594,606 | B1 * | 7/2003 | Everitt | 702/107 |
| 6,788,298 | B1 * | 9/2004 | Kota et al. | 345/204 |
| 2002/0167471 | A1 * | 11/2002 | Everitt | 345/76 |
| 2002/0167474 | A1 * | 11/2002 | Everitt | 345/82 |
| 2002/0167475 | A1 * | 11/2002 | Dennehey | 345/82 |

FOREIGN PATENT DOCUMENTS

| | | |
|---|---|---|
| EP | 1 071 070 | 1/2001 |
| EP | 1 071 070 | 1/2002 |

OTHER PUBLICATIONS

Jos Van Haaren, et al, Recent Advances in Displays for Portable Products, Presentation, Jul. 21, 2000, 6 pages, Tokyo, Japan.

Philips First To Announce Polymer-Based OLED Technology Available For Production Use, Press Release, Jun. 8, 2001, 2 pages, Internet: [retrieved Nov. 7, 2001] <http://www.philips.se/news/010608/polymer.htm>.

MXED202 128-Channel OLED Row Driver, Specification, May 21, 2001, 16 pages, Internet: <http://www.clare.com>.

Patent Abstracts of Japan, vol. 2000, No. 15, Apr. 6, 2001—JP 2000347613 (Mitsubishi Electric Corp.), Dec. 15, 2000.

Patent Abstracts of Japan, vol. 1995, No. 05, Jun. 30, 1995—JP 07036409 (Mitsubishi Electric Corp.), Feb. 7, 1995.

* cited by examiner

*Primary Examiner*—Kent Chang
(74) *Attorney, Agent, or Firm*—The Hecker Law Group, PLC

(57) ABSTRACT

A method and apparatus for driving light emitting polymer (PolyLED) displays is provided. Because PolyLED displays exhibit high capacitance characteristics, pre-charge current is injected to bring the diode up to near its operating current prior to enabling the diode. Thus, time and power is not wasted charging and discharging the high capacitance that is inherent in PolyLED displays and life of the diodes are prolonged because the diodes are not required to swing the full voltage range during each cycle. In addition, since older diodes need more voltage to produce the same current thus the same light intensity as newer diodes, an embodiment of the present invention adds an adaptive power generation system that actively monitors and adjusts power as necessary in order to generate constant amount of light (i.e., constant current) from all the diodes in the display.

46 Claims, 7 Drawing Sheets

METHOD AND APPARATUS FOR DRIVING LIGHT EMITTING POLYMER DISPLAYS

BACKGROUND OF THE INVENTION

1. Field of the Invention

This invention relates to the field of electronic displays. More specifically the invention relates to drivers for light emitting polymer displays.

2. Background Art

Electronic displays are used in a wide variety of applications today. For instance, digital watches, cellular telephones, computers, handheld electronic diaries (e.g., palm pilot), etc, all use electronic displays. Devices such as printers and copiers use electronic displays to guide the user and provide diagnostic help when necessary. All these devices use different types of display technology which include computer monitors, Liquid Crystal Displays (LCD), and Polymer Light Emitting Diode (PolyLED) displays. Some computer displays, for example, use electronic tubes and others use TFT (thin film transistor) technology. TFT is LCD technology and is commonly used in notebooks and laptop computers. Recently, as the cost of producing TFT displays have dropped, manufacturers have started incorporating them into small portable electronic devices such as telephones and handheld diaries.

PolyLEDs, sometimes called OLED (Organic LED), are thin-film light emitting polymers, sandwiched between a transparent and a metal electrode, a metal backing and a very thin glass or plastic material. The polymer films are arranged in an array of diodes. The polymers emit light when electrons and positive charges are injected from the electrodes and transmitted through the material. PolyLEDs are emissive (like light bulbs) type displays unlike LCDs that are reflective. They are generally arranged as passive matrix displays. Images displayed on a PolyLED display are built up by scanning through the array, sending an intense pulse through each line that is being addressed. The human visual system integrates these pulses into an image with sufficient brightness.

Power Consumption

There are multiple sources of power dissipation in a PolyLED display system (i.e., display and driver). One source is due to the power associated with production of light in the LED, which is the product of the current through the LED and the voltage across the LED. Another source is the resistive losses associated with heating the row and column electrodes in the display. A source of power loss may also be due to precision requirements for current in each pixel thus power may be wasted if precision current sources are required to maintain accuracy between the pixels because some sources may be carrying excess current. Yet another source of power dissipation is due to capacitive losses in charging and discharging the diode capacitances in the display. The capacitance of a PolyLED display is very high because PolyLEDs have thin film polymers sandwiched between two metal plates (i.e., the metal plates are close together). In addition, recent advances in technology have PolyLED displays becoming thinner to fit smaller and lighter devices. Thus, the metal plates are coming closer together therefore increasing the capacitance of the PolyLED displays. Also, in order to reduce power, manufacturers have tended to reduce the current required to produce light to very low levels thus increasing the time used in charging the capacitance of the PolyLEDs. For instance, if the charging time is approximately 50–100 microseconds, and the row time is on the order of 200–300 microseconds, then an unacceptably high percentage of the row time (i.e., pulse width) is used to charge the capacitance. Thus, it is desirable to reduce or eliminate the charging time for each diode in order to preserve a higher percentage of the row time.

An electronic display screen is composed of several pixels. A pixel is the basic unit of programmable color in a computer display. Today's displays typically have thousands of pixels arranged in a matrix of N columns by M rows. As the display gets used over time, some pixels see more current than others. Because not all the pixels are lit all the time, some pixels age faster than others on the same display screen. For instance, when different pictures are displayed on the screen, some pixels will have current for a longer period than others and those pixels that are used more often age faster. The problem with older pixels is that they will not put out as much light as younger pixels when the same voltage is applied across their terminals. Thus, an adaptive method of assuring that each pixel in a display produces approximately the same amount of light is desirable.

Display Drivers

Typically, electronic devices called display drivers provide power to drive the pixels on a display screen. Display drivers are generally built into dedicated Integrated Circuits (ICs). The drivers incorporate all the necessary circuits for proper control of the displays. For the PolyLED display, each column is driven separately by its own circuit which is incorporated into the IC. Thus, for a display screen having a resolution of 102 columns by 65 rows, there are 102 column drive circuits representing one drive circuit for each column and 65 row drive circuits representing one drive circuit for each row.

SUMMARY OF THE INVENTION

This invention describes methods and apparatuses for driving light emitting polymer (PolyLED) displays. In one or more embodiments, circuits for pre-charging and adaptively driving PolyLED displays are provided. A PolyLED display is essentially an array of diodes exhibiting high capacitance characteristics. Since not all the pixels (i.e., diodes) in a display are driven at the same time, some diodes in a PolyLED display age faster than others. A characteristic of the PolyLED is that older diodes require more voltage to produce the same current or light intensity as younger diodes.

Power savings in portable electronic devices is a premium quality. Therefore, most electronic manufacturers employ minimal amount of current to drive the displays so that the amount of power dissipated in producing light is minimized. However, the high capacitance of the PolyLED display, coupled with this minimal amount of current, generally employed to drive these displays, cause a significant delay in the amount of time it takes to charge the capacitors. Thus, power is wasted because of the dual capacitive effect in charging and discharging the PolyLED display. An embodiment of the present invention injects a pre-charge current to bring the pixel up to near its operating voltage prior to enabling the pixel. Thus, time is not wasted charging and discharging the high capacitance that is inherent in PolyLED displays.

In addition, since older diodes need more voltage to produce the same current and thus the same light intensity as newer diodes, an embodiment of the present invention adds an adaptive power generation system that actively monitors and adjusts the power supply voltage as necessary in order to generate constant amount of light (i.e., constant current) from all the diodes in the display. The adaptive scheme also allows the generation of the minimum Row-Off voltage. Reducing the Row-Off voltage improves the PolyLED life and reduces the voltage swing on the row output which reduces power.

DETAILED DESCRIPTION OF THE INVENTION

The invention comprises methods and apparatuses for adaptively driving polymer light emitting diode displays. In the following description, numerous specific details are set forth to provide a more thorough description of embodiments of the invention. It will be apparent, however, to one skilled in the art, that the invention may be practiced without these specific details. In other instances, well known features have not been described in detail so as not to obscure the invention.

In one or more embodiments of the present invention, the apparatuses and methods described herein provide a drive scheme for PolyLED displays that is adaptive in order to provide uniform display characteristics. In an embodiment, Pulse Width Modulation (PWM) technique is used to light-up the diodes. Because electric current is applied to the diodes using PWM, the time accuracy of each pulse is very critical. Thus, an embodiment employs a pre-charge current scheme to improve Pulse Width Modulation resolution which may ultimately result in reducing overall power consumption because of the required accuracy of the column current.

In a typical application, data representing an image to be displayed is passed from an application to the display driver. The driver then processes the data and applies the proper amount of current to the appropriate pixels to generate the image represented by the data.

Figure 1:
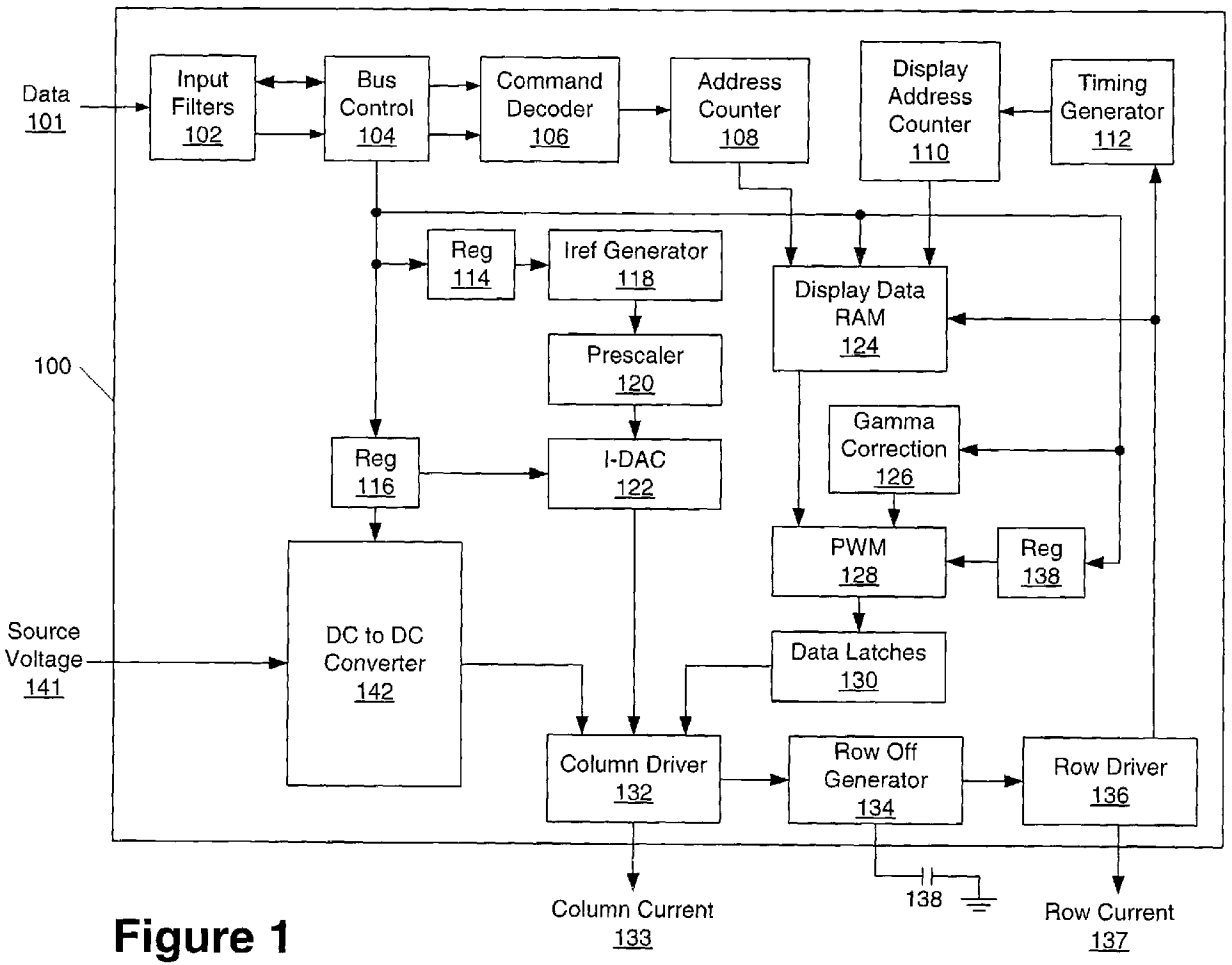
FIG. 1 is a block diagram of a matrix driver for PolyLED displays in accordance with an embodiment of the present invention.

FIG. 1 is a block diagram of a matrix driver for PolyLED displays in accordance with an embodiment of the present invention. In this illustration, Data 101, which may include data to be displayed, system control logic, and system data, is passed to the PolyLED display driver 100 via the system bus to input filters 102, where the data may be filtered as necessary. Data 101 then passes from filter block 102 to Bus Control 104 from which the data is passed to the necessary registers and storage devices. For instance, mode control data may be sent to mode register 114, brightness control data may be sent to Global Brightness Register 116, display data may be sent to system storage RAM (Random Access Memory) 124, pulse width control data may be sent to gamma register block 138, and command data may be sent to Command Decoder block 106. Data from command decoder block 106 is sent to Address Counter 108 for determination of address in RAM 124 where system data is stored.

Driver 100 also contains Timing Generator block 112, Reference Current (Iref) Generator 118, Current Prescaler 120, Digital-to-Analog (I-DAC) converter 122, DC to DC Converter 142, Column Driver 132, Row-Off Generator 134, Row Driver 136, Gamma Correction Block 126, Pulse Width Modulation (PWM) 128, and Data Latches 130. Timing Generator block 112 generates the system clock for driver 100. Timing generator 112 may use an internally located oscillator or an external clock, depending on user preference, to generate the system clock. The generated clock is passed to Display Address Counter 110 which is coupled to RAM 124.

Reference Current Generator 118 extracts the programmable drive current for each pixel which is then scaled in Prescaler 120. The reference current and the global brightness data from register 116 are converted to analog signals in I-DAC 122 (also known as the global brightness DAC). Thus, a combination of Prescaler 120 and the global brightness data (in Register 116) determine the output Current needed for driving each column. Gamma correction block 126 may apply preprogrammed gamma correction to the display data available from RAM 124 which determines the width of the PWM signal. In other embodiments, gamma correction block 126 may directly control the PWM without manipulating the data. Thus, the data from RAM 124 may determine the width of each pulse while gamma correction block 126 controls the spacing between the pulses, for example.

Register block 138 (also known as gamma registers) is a set of fifteen registers having values to control the width of the pulse generated by PWM block 128. The pulse width modulated data is then passed to column driver 132 through Data Latches block 130. Column Driver block 132, DC to DC Converter block 142, Row Off Generator 134 and Row Driver 136 combine to generate and drive the appropriate pixels according to the reference (e.g., pre-charge) current and data requirements as illustrated in FIG. 2.

Figure 2:
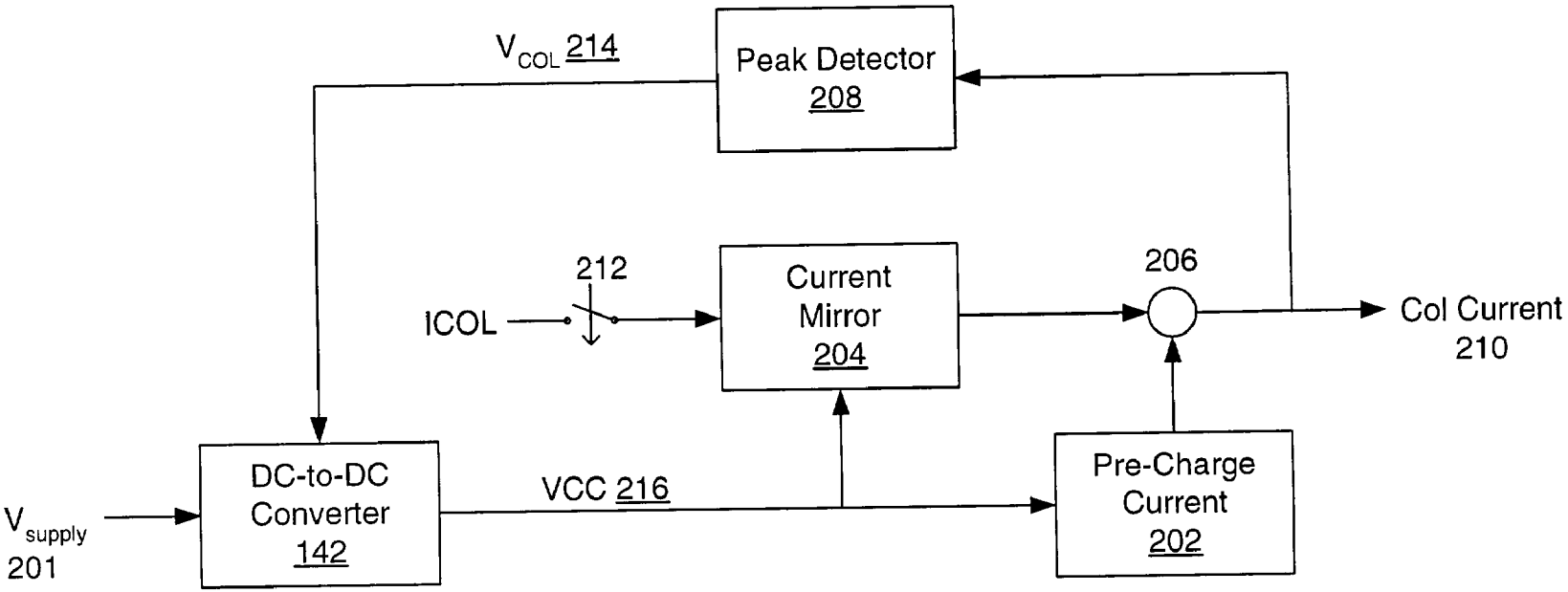
FIG. 2 is an illustration of the adaptive voltage and pre-charge current control and drive scheme in accordance with an embodiment of the present invention.

FIG. 2 is an illustration of the adaptive voltage and pre-charge current control and drive scheme in accordance with an embodiment of the present invention. The drive scheme includes DC-to-DC converter block 142 with output VCC 216, current mirror 204, peak detector 208 with output Vcol 214, and pre-charge current block 202. The DC-to-DC converter block 142 receives battery or external power input voltage 201 and maximum diode voltage, Vcol 214, as feedback to adaptively control the voltage applied to each diode in the PolyLED display. The voltage applied across each PolyLED diode is variable depending on the life of the diode. One object of the present invention is to apply the same current to all the diodes thus producing the same light intensity. Thus, since older pixels (diodes) require more voltage to generate the same light intensity, DC-to-DC converter 142 adaptively generates more or less voltage as necessary for the column driver to supply the proper amount of current. The DC-to-DC converter generates the minimum amount of voltage necessary, plus overhead, to drive each column. Peak detector 208 continuously monitors the column voltage and stores the peak voltage detected from all the columns combined and feeds that information to DC-to-DC converter 142 as Vcol 214.

The desired DC-DC converter output voltage may be obtained by determining the maximum diode voltage encountered during use. For instance, assuming there are many columns and pixels in a display, some of the pixels in the LED will need more voltage and some will need less. One way of determining the maximum voltage is by scanning the display columns and observing the maximum peak voltage that occurs in real-time. The maximum diode voltage may then be computed by adding a delta (for padding) voltage on to the maximum observed voltage.

The maximum diode voltage is an internal voltage inside the driver circuitry. It is used in the matrix display driver to minimize the row swings for display life reasons and to save power. The maximum diode voltage may also be used to compute the Row-Off voltage. The row off voltage is generated on chip and it determines how far the row swings in a positive sense. The rows swing to ground in the negative sense, but they swing to the internally generated row off voltage which is computed from the maximum diode voltage. The maximum diode voltage may also be provided to DC-to-DC converter 142 which adaptively provides the voltage source needed to drive the display.

The DC-to-DC converter is a feedback system that provides power to the driver circuitry. It will be apparent to those of ordinary skill that other power sources may be used to power the driver. For instance, an external power source may be used whereby the feedback voltage is sent outside the IC and the drive voltage is returned. In any case, the DC-to-DC converter provides power on demand. When there is no demand for additional power, the DC-to-DC converter gradually reduces its power output. A simplified schematic of the DC-to-DC converter may be represented as an integrating element with an input comprising the difference (i.e., error) between a desired voltage and the column voltage, and output represented as VCC in FIG. 2. Thus, the DC-to-DC converter is an adaptive power supply source for powering the matrix display driver.

In one embodiment, current is sent to energize a pixel when a non-zero data is present in memory for that pixel location. Thus, when data for a particular pixel is non-zero, a predetermined pre-charge current is applied by block 202 to the pixel just prior to when the data is to be displayed. The pre-charge current may be instantaneously applied or ramped up to the predetermined value at a predetermined rate. In all cases, the pre-charge current may be applied for a predetermined (i.e. pre-programmed) amount of time (i.e., pre-charge time). The pre-charge time may be stored in a time-control register, for example. Other embodiments may use adaptive techniques to determine the adequacy of the pre-charge time. The pre-charge current may be substantially larger than the normal diode current in order to quickly ramp the diode voltage to the desired level.

After the expiration of the pre-charge time, the pre-charge current may be turned off. Meanwhile, switch 212 closes when the column is enabled. Predetermined current ICOL, from the global brightness DAC 122, flows to the Current Mirror 204 which then generates the desired amount of drive current flowing through the diode. In this simplified scheme, the pre-charge and the drive currents sum at block 206 to generate the column current available as output 210.

In accordance with an embodiment of the present invention, the pre-charge scheme is such that a fixed amount of current is pumped out to a column for a fixed amount of time. Essentially, pre-charge block 202 dumps a finite amount of charge to the display in order to take the voltage on the display up to near the desired value. In one embodiment, after reaching the end of the pre-charge (i.e., pre-programmed) time, the pre-charge circuit 202 is turned off and the column drive falls back to the normal current source which pumps out the remaining current required to charge the display the rest of the way. In other embodiments, the pre-charge circuit 202 may also or alternatively be turned off after reaching a desired voltage. However, such a scheme may require a comparator to determine when the desired voltage is reached. The pre-charge current may be on the order of two milliamps, for example.

In a typical embodiment of the present invention, the display rows are scanned one at a time while current is provided to the appropriate columns as needed. For instance, for each selected row or row being scanned, current may be provided to drive one or all of the columns in the matrix. Column and row drive schemes in accordance with embodiments of the present invention are discussed below.

Column Driver

Figure 3:
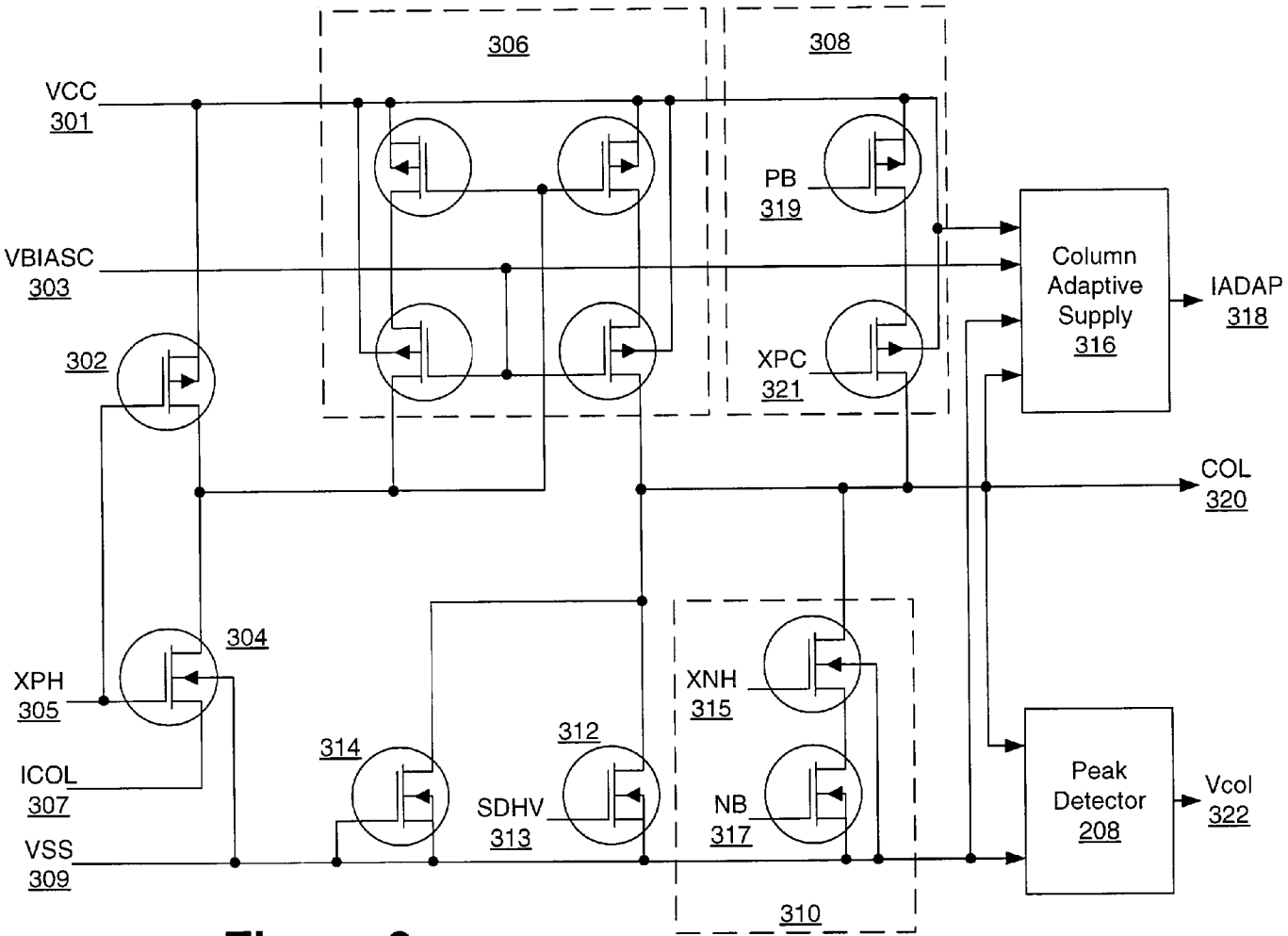
FIG. 3 is a lower level illustration of a column driver circuitry in accordance with an embodiment of the present invention.

FIG. 3 is a lower level illustration of a column driver circuitry in accordance with an embodiment of the present invention. Note that there is one column driver circuitry, as shown in FIG. 3, for each column in the matrix display. The column driver circuit includes current mirror 306, pre-charge current generator 308, weak device 310, strong device 312, Column Adaptive Supply 316, Peak Detector 208, and other MOS transistors (i.e., MOSFETs 302, 304, and 314). The output voltage of the DC-to-DC converter, VCC 301, is the power source for driving the column current. VCC 301 feeds into current mirror 306 and pre-charge driver 308. The current mirror provides a high output impedance of the drive current to produce the steady state column current with minimal distortion. The bias voltage, VBIASC 303, feeding into current mirror 306 and column adaptive supply 316 may be a preprogrammed or an operating voltage that is actively computed. Pre-charge current generator 308 ramps the column pre-charge current to a level specified by gate input PB 319 over a period controlled by gate input XPC 321.

MOSFET 304 acts like a switch. The global brightness DAC (I-DAC 122) generates the current source ICOL 307. When MOSFET 304 is engaged, current ICOL 307 flows into current mirror 306 which in turn generates the steady state column current. Thus, when current needs to be generated at COL 320, MOSFET 304 is turned on causing current to flow from ground, through the global brightness DAC, through MOSFET 304, and through current mirror 306. The high output impedance of the current mirror makes it possible to maintain constant current. Constant current is important to generate the same light intensity from the various pixels in the display. MOSFET 302 (e.g., p-channel) together with MOSFET 304 (e.g., n-channel) forms an inverter pair. MOSFET 304 turns on the current switch so that current flows from ICOL 307 when current is needed at the output, COL 320, while MOSFET 302 disables and holds the current off when no current is needed at the output, COL 320. The input, XPH 305, to the gates of both transistors is an active-high signal for driving the MOS transistors.

MOSFET 314 provides protection for output, COL 320. MOSFET 312 is the strong pull-down device. It has a high voltage input, SDHV 313, to the gate of the MOSFET which is used for enabling the strong pull-down device. When engaged, the strong pull-down device holds the column to ground. The pair of MOSFETs in block 310 comprises the weak pull-down device. Input XNH 315 to weak pull-down device 310 is an active-high signal which activates the weak pull-down device while NB 317 is the bias voltage. The functions of the strong and weak pull-down devices are illustrated in the following example:

Assuming that the column driver, COL 320, starts putting out zero volts, the pre-charge device 308 takes the voltage up to at or near a predetermined voltage, for example, ten volts. In one or more embodiments, this is achieved by the pre-charge circuit putting out a predetermined amount of charge. Note that, for a fixed amount of pre-charge current, the actual column voltage may differ depending on the age of the pixel (V=IR) being driven. This is because as a pixel ages, its resistance, R, increases thus from the relationship V=IR, more voltage is required to generate a fixed amount of current. In any case, the display ends up with a certain voltage. The pre-charge circuit is then turned off while the current source, ICOL 307, is turned on to generate the required column current for a certain period of time before it is eventually turned off. In the present embodiment the current from current mirror 306 is used by the display to generate light. A larger current from pre-charge current generator 308 is used to charge the capacitance of the diode, and this current is turned off before the diode voltage reaches a level where light would be emitted.

When the column current source is turned off, weak device 310 is used to pull the output (i.e., COL 320) down. The weak device puts out current that is approximately negative of the pre-charge current. One concept of the weak device may ramp the current output, COL 320, down at about the same rate that it was ramped it up. And then when the output reaches ground, strong device 312 may be turned on to hold the output at ground. Thus, weak device 310 helps reduce the possibility that the present column will inject disturbances (e.g., spike) into other columns when the present column is turned off. The strong device, 312, holds the present column to ground even though other things in the matrix driver were switching, for example, the beginning of the next cycle, or other columns. For instance, assume an embodiment with one hundred two (102) columns where one column driver remains off while the remaining one hundred one (101) columns are turned on. The one column that's supposed to be off and supposed to stay at ground must hold itself at ground while the remaining 101 columns go ramping up to the pre-charge voltage (e.g., 10 volts). Now, although all the column drivers are separate in the Integrated Circuit, they are all connected by the array of capacitors, that is, the capacitance of the PolyLED discussed earlier. Therefore, the problem is because the display has such high capacitance, coupling occurs from column to column, from columns to rows, and from rows to columns. The strong and weak devices provide the required isolation.

Figure 4:
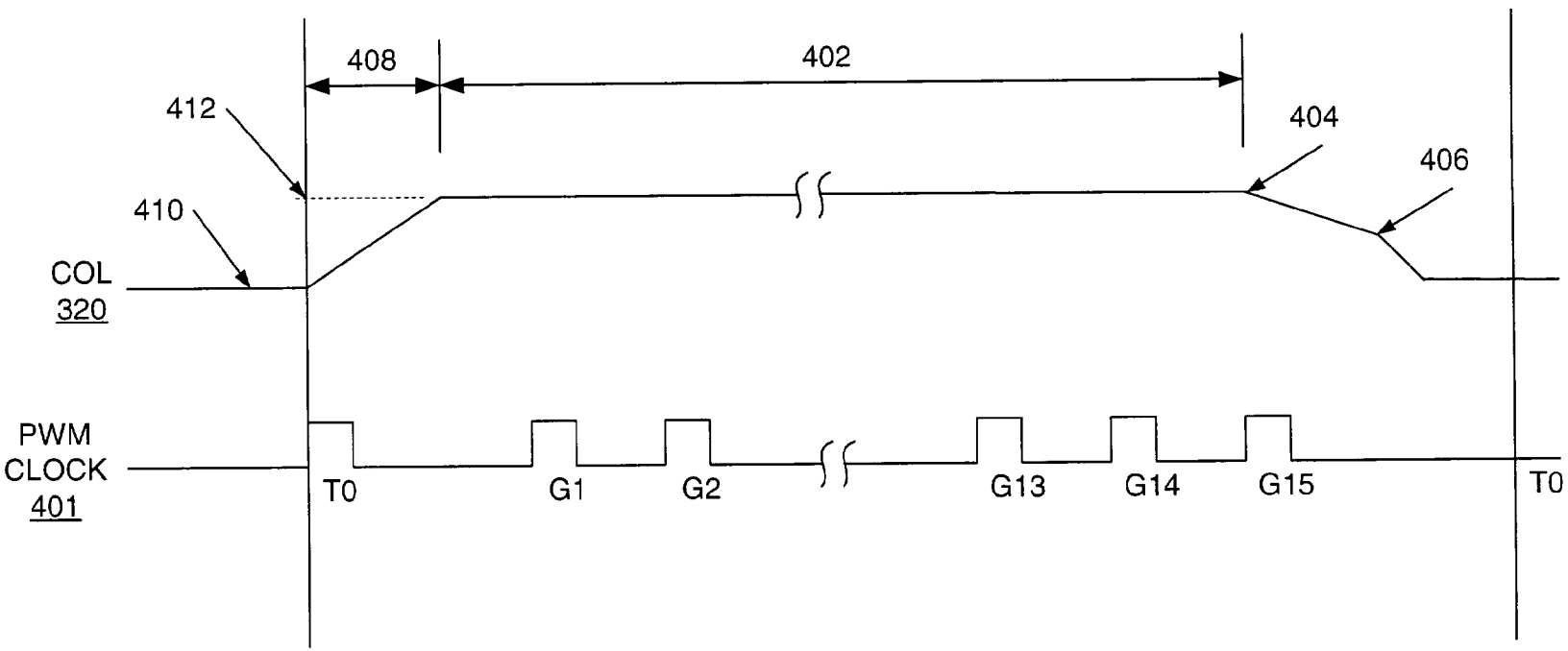
FIG. 4 is an illustration of how the column current is driven in accordance with an embodiment of the present invention.

FIG. 4 is an illustration of how the column current is driven in accordance with an embodiment of the present invention. At time t0, if there is non-zero data in memory (e.g., RAM 124), the pre-charge current circuit (i.e., 308) starts to ramp up COL 320 from ground voltage 410 to the pre-charge voltage value 412. The time, represented by region 408, that it takes to ramp up to the pre-charge voltage may be predetermined and can be any desired value. Thus, from T0 to ramp up time, the column voltage ramps from ground to the pre-charge voltage. At the end of the predetermined ramp time, the pre-charge current is turned off and the current source (i.e., device 304) is turned on. The length of the flat portion of the COL 320 curve, i.e., region 402 depends on the data in the gamma registers (i.e., G1–G15). Thus the value in the gamma registers determines the total width of the output current pulse.

In an embodiment of the present invention where the pixel intensity is based on a 4-bit word, fifteen gamma registers, G1 to G15, (note that G0 is not needed since no current is produced when the data is zero) may be used. The fifteen registers represent how long PWM device 128 maintains a pulse (i.e., the pulse width) if the data requires it. The output signal of PWM 128 is shown as PWM CLOCK 401 in FIG. 4. Note that the spacing between the pulses of the PWM CLOCK 401 can be controlled arbitrarily and is not necessarily uniform. In fact, non-uniform spacing of these pulses can be used to generate a non-linear relationship between the 4-bit words and the drive time for the diode. It is this non-linear relationship that accomplishes gamma correction for the display.

The response illustrated in FIG. 4 may be used to show how the pre-charge circuit and the current source drivers operate, in an embodiment of the present invention. Assuming a pulse is generated for each of the fifteen registers that contain a time value, then where the 4-bit gamma register data value is 1111, the data in each of the fifteen registers (i.e., G1–G15) will be used in the generation of the pulse. Thus, the pulse (i.e., 402), generated by PWM 128, will remain high until the rising edge of the G15 pulse. At the rising edge of the G15 pulse, the current source is turned off and the weak device, 310, is turned on (i.e., at point 404). When weak device 310 is turned on, the output current of the present column is ramped down at a certain rate thus minimizing injection of transients into the remaining non-driving columns. Note that gamma correction may not be needed in this case since the data in registers G1 through G15 are equally spaced, i.e., the total time is equally divided between the registers.

At G15 plus a predetermined number of clock cycles (e.g., at point 406), or a pre-determined event, strong device 312 is turned on to hold COL 320 to ground. An example number of clock cycles may be 10 cycles. This pulse width modulation cycle repeats so long as the display data is non-zero. In the case where the data in memory is zero (i.e., 0000) then COL 320 remains flat at ground 410. This pulse width modulation concept provides a total of sixteen (16) gray-scale levels for each pixel. For color displays or for higher number of gray scale levels, a larger intensity word may be required. For instance, an 8-bit word may be used to generate 256 color variations.

Peak Detector

As the display gets used over time, the total amount of current passed into the various display elements (i.e., pixels) differs. Therefore, some pixels will be used more than others, unless the use is such that all the pixels have the same amount of light all the time. Thus, if a few pixels are turned on at the same time a few are turned off, or if pictures on the screen constantly change, some pixels will have current in them longer than others, and one of the artifacts of the PolyLED display is that the pixels age, hence the concept of applying constant current to obtain consistent pixel intensity. However, if the pixels did not age, simply applying the same voltage (e.g., 10 volts) may cause the pixels to produce the same light intensity. But the problem is that the pixels do age, and in order to get enough current to flow through the pixels, more voltage is needed across the junctions of older pixels to get the same current and thus light intensity.

For instance, a brand new display has many pixels that are young. As the display is used over time, some of the pixels on the display will age faster than the others because of the differing amount of times each pixel is used. If a voltage adjustment is not made for the older pixels, what happens is that for a given voltage, the younger pixels are brighter than the older pixels. This is because the younger pixels consume more current than the older pixels for the same voltage. Thus, for a display that has been used, if at any instant there is a desire to light up a handful of pixels or hundreds of pixels on the screen, it is desirable to know how much voltage it takes to light up the oldest pixel. One embodiment measures and memorizes how much voltage is required to light up the oldest pixel. That is, a circuit may be employed that determines how much voltage the oldest pixel will take to generate the same fixed amount of current (e.g., 200 microamperes) as a younger pixel. In one or more embodiments, the peak detector circuit, 208, is used to perform this function.

Figure 5:
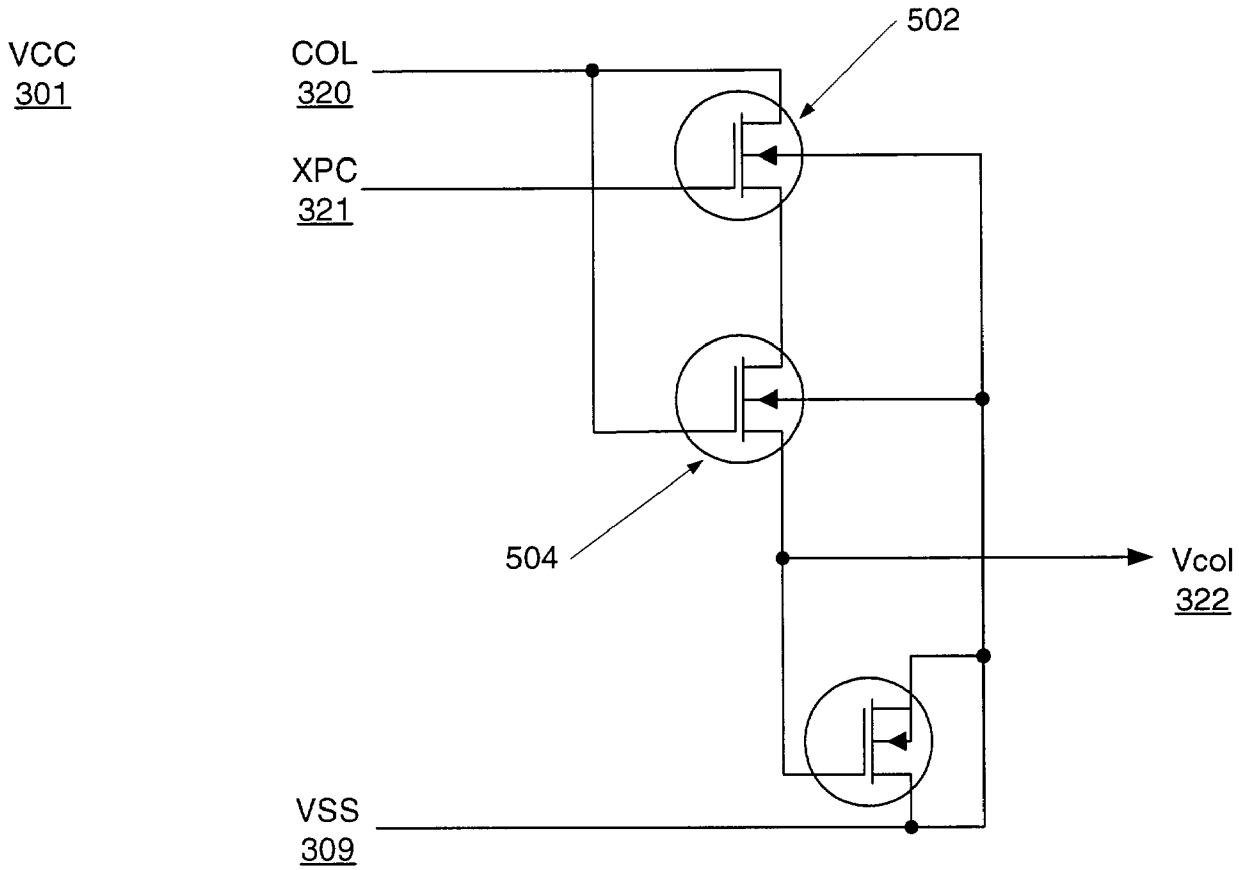
FIG. 5 is an illustration of a peak detector circuitry in accordance with an embodiment of the present invention.

FIG. 5 is an illustration of a peak detector circuitry in accordance with an embodiment of the present invention. The column drive voltage, COL 320, is passed as input into the source of MOSFET 502 and gate of MOSFET 504. At assertion of XPC 321, the maximum voltage is read and made available at VCOL 322. VSS 309 provides ground reference for the circuit. In one embodiment, there is a peak detector for every column driver output. The peak detector may be thought of as a matrix of diodes, and the idea is to find the maximum of all the elements in a row at any instance. This maximum voltage is used to cause DC-to-DC converter 142 to put out more voltage (VCC) which is used to run the matrix driver. This process is continuous because if an older pixel wants even a higher voltage then the signal goes back to the converter to ask for even more voltage which is then fed back into the driver. Thus, the system may be adaptive to the needs of each individual pixel in the display. The DC-to-DC converter simply puts out a higher voltage when the peak detector outputs a higher output voltage (VCOL 322) than the bias voltage VBIASC 303. The mechanism whereby the DC-to-DC converter is asked to produce more voltage is discussed below with respect to the Column Adaptive Supply module.

In one or more embodiments, VCOL 322 is the output of all peak detectors shorted together thus it is the maximum detected column voltage (COL). It would be apparent to those of skill in the art that diodes or other devices may be used for the peak detector instead of transistors. For instance, diodes may be used because they will not need switching and would push the current through when COL 320 was above a certain threshold (e.g., VBIASC 303).

The peak detector is connected to the display at all times and is enabled for each display row. After the driver has scanned all of the display rows, the shorted detector output, VCOL 322 has a sample of the largest diode voltage on the entire display.

Column Adaptive Supply

Figure 6:
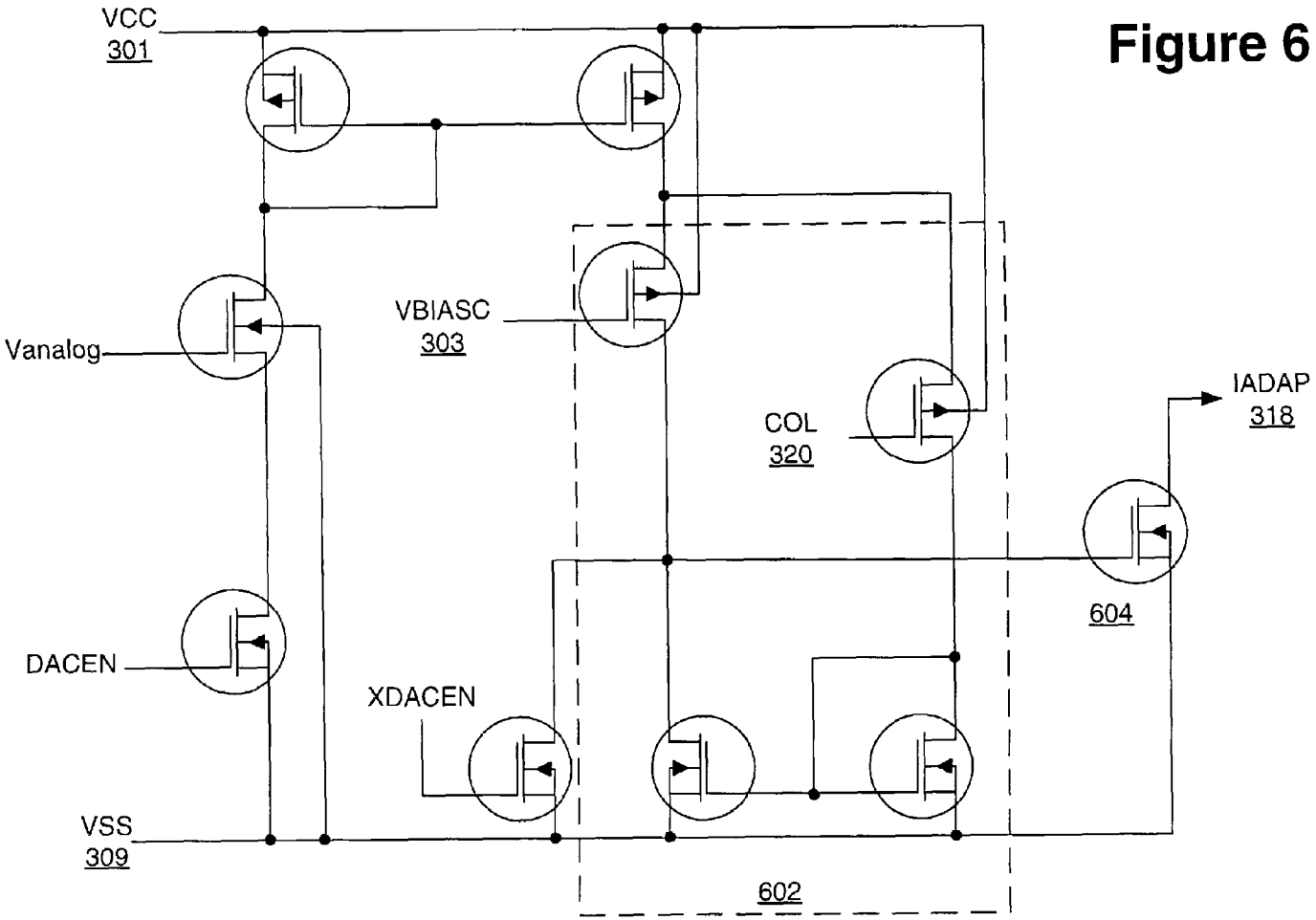
FIG. 6 is an illustration of a column adaptive circuitry in accordance with an embodiment of the present invention.

FIG. 6 is an illustration of a column adaptive circuitry in accordance with an embodiment of the present invention. The circuitry controls whether or not the DC-to-DC converter puts out more voltage. The two important inputs to the column adaptive circuit are VBIASC 303 and COL 320. The column adaptive circuit is basically a comparator that compares those two signals (i.e., VBIASC and COL). The comparison is performed by the four transistors in block 602 which act like a differential comparator. The output, IADAP 318, is available from transistor 604 which is an open drain device. There is one of these circuits (FIG. 6) for each column and all the outputs are wired-ORed (i.e., shorted) together.

For instance, assuming there are 102 columns in a display, then all 102 copies of IADAP 318 are all shorted together. Thus, if during the comparison a particular output decides that it needs more voltage, Transistor 604 turns on and pulls node IADAP 318 down. And since the 102 copies are wired-OR together, if any one of them indicates that more voltage is needed, the DC-to-DC converter tries to put out a little more voltage. When the DC-to-DC converter puts out enough voltage, and all the comparators are satisfied with their comparison of the present column voltage (i.e., COL 320) to the present bias voltage (i.e., VBIASC 303), then all 102 of the Transistor 604 devices will be off and thus the circuit will stop asking for more voltage. Thus, if any one of the 102 column outputs is suddenly attached to an older diode, that column output (i.e., COL 320) goes up above the VBIASC 303 voltage and Transistor 604 turns IADAP 318 on again to demand for more voltage from the DC-to-DC converter. The converter keeps increasing its voltage output, up to its maximum capacity or preprogrammed limit, so long as the comparator output, IADAP 318, is requesting for more voltage.

Row Driver

Figure 7:
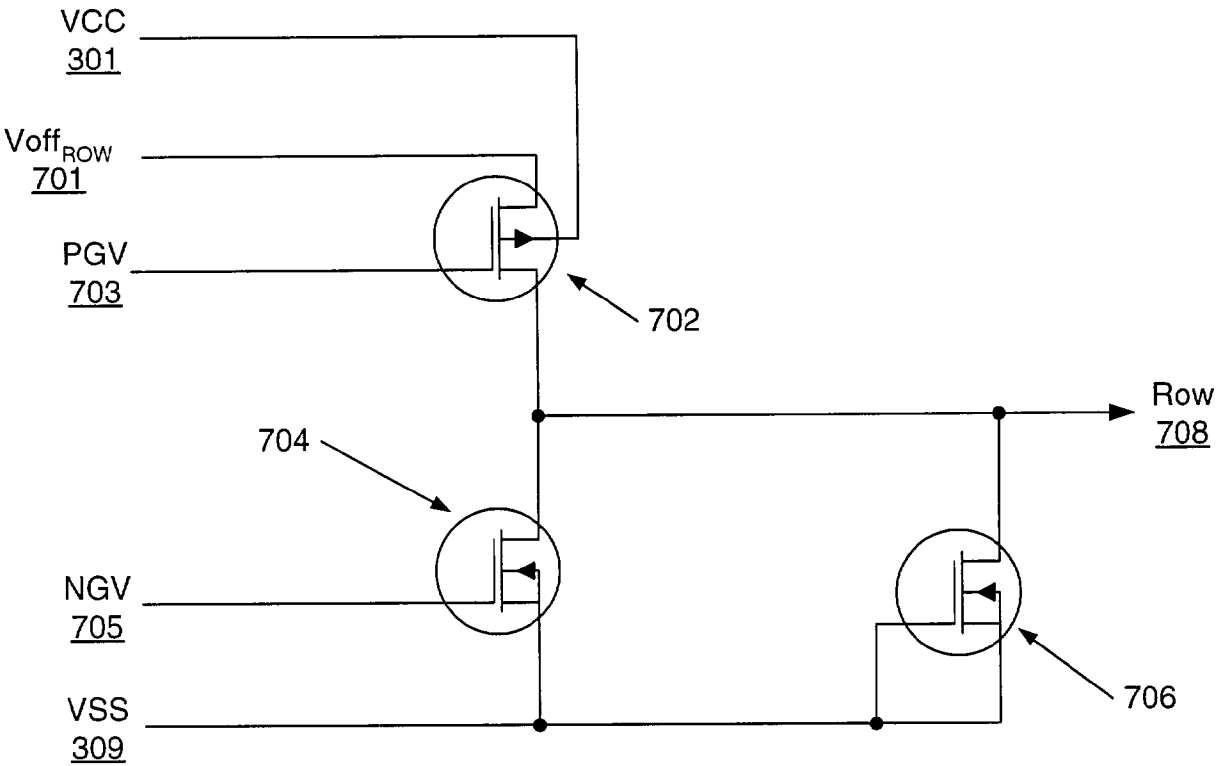
FIG. 7 is an illustration of a row driver in accordance with an embodiment of the present invention.

FIG. 7 is an illustration of a row driver in accordance with an embodiment of the present invention. When turned on, the row drivers provide a low impedance path from the selected row to ground (e.g., VSS 309). When turned off, the row drivers drive the output to the RowOff voltage. The RowOff voltage is the maximum diode voltage plus a threshold. In the illustration of FIG. 7, device 702 is a p-channel MOSFET while devices 704 and 706 are n-channel MOSFETs. Turning on device 704 causes the output, Row 708, to drag low thereby turning on the row in the matrix. On the other hand, if device 702 is turned on, it takes Row 708 high thereby turning off the row. Device 706 provides Electrostatic Static Discharge (ESD) protection for output Row 708.

The source of transistor 702 is tied to the Row-Off Voltage ($Voff_{ROW}$) 701. Since device 702 is a p-channel MOSFET, the body gets the most positive voltage which is VCC in this embodiment. For transistor 704, which is an n-channel MOSFET, the body has to be the most negative thus it is tied to the drain and they both (i.e., the body and the drain) are connected to ground VSS 309. The input signal PGV 703 is tied to the gates of MOSFET 702. Input PGV 703 is the active high component of signals XPH 305. Input signal NGV 705 is the active high component of XNH 315 and it is tied to the gate of MOSFET 704.

In one or more embodiments, $Voff_{ROW}$ 701 maintains a value less than the maximum column voltage. $Voff_{ROW}$ 701 may be computed as the difference between the maximum column voltage (VBIASC) and a constant (e.g., 1.5 volts). The difference may then be buffered to generate $Voff_{ROW}$ 701. Using a value less than the maximum column voltage for $Voff_{ROW}$ prevents the row from swinging the full rail to rail. Instead, by continuously computing the $Voff_{ROW}$ voltage, the row tracks up and down and doesn't swing as far thus dissipating less power and preserving the diodes by preventing excessive reverse biasing (of the diodes).

Thus, a method and apparatus for driving light emitting polymer displays have been described in conjunction with one or more specific embodiments. The invention is defined by the claims and their full scope of equivalents.

The invention claimed is:

1. An apparatus for driving a display device having a plurality of diodes arranged in a matrix of a plurality of rows and a plurality of columns, said apparatus comprising:

an adaptive power source using a feedback of peak voltage to generate an output voltage to source a fixed current flow through said plurality of diodes;

a plurality of pre-charge circuits driven by said output voltage, each of said plurality of pre-charge circuits providing a desired pre-charge current;

a plurality of current mirror circuits, each of said plurality of current mirror circuits using a fixed current reference and said output voltage to provide a drive current;

a plurality of summers, each of said plurality of summers receiving corresponding ones of said pre-charge current and said drive current to generate a total column current for each of said plurality of columns of said plurality of diodes of said display device.

2. The apparatus of claim 1, wherein said display device comprises a polymer light emitting diode device.

3. The apparatus of claim 1, wherein said display device comprises an organic light emitting diode device.

4. The apparatus of claim 1, wherein said peak voltage is the maximum voltage detected from said plurality of columns of said plurality of diodes.

5. The apparatus of claim 1, wherein said plurality of rows are driven one row at a time.

6. The apparatus of claim 1, wherein said drive current is pulse width modulated.

7. The apparatus of claim 1, wherein said drive current is provided when said pre-charge current is disabled.

8. An apparatus for driving a display device having a plurality of diodes arranged in a matrix of a plurality of rows and a plurality of columns, said apparatus comprising:

an adaptive power source for generating a device voltage, said adaptive power source using a maximum voltage as feedback to generate said device voltage, wherein said device voltage results in a fixed current flow through said plurality of diodes;

a plurality of current mirror circuits providing drive current to said plurality of columns, each of said plurality of current mirror circuits using a fixed current reference and said device voltage from said adaptive power source to provide said drive current to each of said plurality of columns of said plurality of diodes of said display device; and a peak voltage detector obtaining said maximum voltage from said plurality of columns.

9. The apparatus of claim 8, wherein said display device comprises a polymer light emitting diode device.

10. The apparatus of claim 8, wherein said display device comprises an organic light emitting diode device.

11. The apparatus of claim 8, wherein said plurality of rows are driven one row at a time.

12. The apparatus of claim 8, wherein said drive current is pulse width modulated.

13. The apparatus of claim 8, wherein said power source comprises a DC-to-DC voltage generator.

14. The apparatus of claim 8, wherein said power source provides adaptive adjustment of said device voltage to produce approximately equal light intensity from all of said plurality of diodes.

15. The apparatus of claim 14, wherein said adaptive adjustment of said device voltage comprises:

using feedback of said maximum voltage to said power source for said adaptive adjustment of said device voltage.

16. The apparatus of claim 15, wherein said drive current is provided to said plurality of columns and said peak voltage detector obtains said maximum voltage from said plurality of diodes by determining said maximum voltage from a plurality of voltages across said plurality of columns.

17. The apparatus of claim 16, wherein said adaptive adjustment of said device voltage comprises:

continuously comparing each of said plurality of voltages across said plurality of columns with said maximum voltage; and adjusting said device voltage in accordance with said maximum voltage.

18. The apparatus of claim 16, wherein said adaptive adjustment of said device voltage comprises:

said power source increasing said device voltage when said each of said plurality of voltages across said plurality of columns is less than said maximum voltage; and said power source decreasing said device voltage when said each of said plurality of voltages across said plurality of columns is greater than said maximum voltage.

19. An apparatus for driving a display device having a plurality of diodes arranged in a matrix of at least one row and at least one column, said apparatus comprising:

a power source for adaptively providing a device voltage adequate for applying a fixed current flow through said plurality of diodes;

a pre-charge circuit for providing a desired pre-charge current for each of said at least one column of said matrix, wherein said pre-charge circuit receives operating power from said power source;

a voltage detector device for determining a maximum voltage across said at least one column of said matrix, said maximum voltage being fed back to said power source for adaptive adjustment of said device voltage;

a current mirror circuit providing drive current for said each of said at least one column, said current mirror circuit providing said drive current to said each of said at least one column of said matrix of said plurality of diodes of said display device when said pre-charge circuit is disabled.

20. An apparatus for driving a display device having a plurality of diodes arranged in a matrix of a plurality of rows and a plurality of columns, said apparatus comprising:

a power source for adaptively providing a device voltage adequate for sourcing a fixed current flow through said plurality of diodes;

a plurality of pre-charge circuits for providing a desired pre-charge current to said plurality of columns of said plurality of diodes of said display device, each of said plurality of pre-charge circuits receiving power from said power source;

a plurality of current mirror circuits providing drive current to said plurality of columns, each of said plurality of current mirror circuits using a pre-programmed current and said device voltage from, said power source to provide said drive current to each of said plurality of columns of said plurality of diodes of said display device.

21. The apparatus of claim 20, wherein said display device comprises a polymer light emitting diode device.

22. The apparatus of claim 20, wherein said display device comprises an organic light emitting diode device.

23. The apparatus of claim 20, wherein said pre-charge current and said drive current are summed as voltages to produce a column voltage for each of said plurality of columns of said plurality of diodes.

24. The apparatus of claim 20, wherein said plurality of rows are driven one row at a time.

25. The apparatus of claim 20, wherein said drive current is pulse width modulated.

26. The apparatus of claim 20, wherein said drive current is provided when said pre-charge current is disabled.

27. The apparatus of claim 20, wherein said power source comprises a DC-to-DC voltage generator.

28. The apparatus of claim 23, wherein said power source provides adaptive adjustment of said device voltage to produce approximately equal light intensity from all of said plurality of diodes.

29. The apparatus of claim 28, wherein said adaptive adjustment of said device voltage comprises:

using a plurality of voltage detector devices for determining a maximum voltage from said plurality of diodes; and feeding back said maximum voltage to said power source for said adaptive adjustment of said device voltage.

30. The apparatus of claim 29, wherein said determining said maximum voltage from said plurality of diodes comprises extracting said maximum voltage from a plurality of column voltages of said plurality of diodes.

31. The apparatus of claim 30, wherein said adaptive adjustment of said device voltage comprises:

comparing each of said plurality of column voltages with said maximum voltage; and adjusting said device voltage in accordance with said maximum voltage.

32. The apparatus of claim 30, wherein said adaptive adjustment of said device voltage comprises:

said power source increasing said device voltage when said column voltage is less than said maximum voltage; and said power source decreasing said device voltage when said column voltage is greater than said maximum voltage.

33. A method for driving a display device comprising:

coupling a matrix driver with a display device having a plurality of diodes arranged in a matrix, said matrix having a plurality of columns and a plurality of rows;

obtaining a device voltage from a power source for powering said plurality of diodes of said display device, wherein said power source adaptively adjusts said device voltage to maintain a fixed current across said plurality of diodes;

providing a desired pre-charge current to each of said plurality of columns of said diodes of said display device from one of a plurality of pre-charge circuits, each of said plurality of pre-charge circuits receiving power from said power source;

using a plurality of current minor circuits to provide drive current to said plurality of columns, each of said plurality of current mirror circuits using a known current source and said device voltage to generate said drive current to each of said plurality of columns of said plurality of diodes of said matrix.

34. The method of claim 33, wherein said display device comprises a polymer light emitting diode device.

35. The method of claim 33, wherein said display device comprises an organic light emitting diode device.

36. The method of claim 33, wherein said pre-charge current and said drive current are summed and provided to said diodes to produce a column voltage for each of said plurality of columns of said plurality of diodes.

37. The method of claim 33, wherein said plurality of rows are driven one row at a time.

38. The method of claim 33, wherein said drive current is pulse width modulated.

39. The method of claim 33, wherein said drive current is provided when said pre-charge current is disabled.

40. The method of claim 33, wherein said power source comprises a DC-to-DC voltage generator.

41. The method of claim 36, wherein said power source provides adaptive adjustment of said device voltage to produce approximately equal light intensity from all of said plurality of diodes.

42. The method of claim 41, wherein said adaptive adjustment of said device voltage comprises:

using a plurality of voltage detector devices for determining a maximum voltage from said plurality of diodes; and feeding back said maximum voltage to said power source for said adaptive adjustment of said device voltage.

43. The method of claim 42, wherein said determining said maximum voltage from said plurality of columns comprises extracting said maximum voltage from a plurality of column voltages of said plurality of diodes.

44. The method of claim 43, wherein said adaptive adjustment of said device voltage comprises:

comparing each of said plurality of column voltages with said maximum voltage; and adjusting said device voltage in accordance with said maximum voltage.

45. The method of claim 43, wherein said adaptive adjustment of said device voltage comprises:

said power source increasing said device voltage when said column voltage is less than said maximum voltage; and said power source decreasing said device voltage when said column voltage is greater than said maximum voltage.

46. A method for driving a display device comprising:

coupling a display device having a plurality of diodes arranged in a matrix having at least one column and at least one row with a driver device, said driver device coupled with said matrix of said plurality of diodes of said display device;

generating a device voltage for powering said plurality of diodes of said display device, wherein said device voltage adaptively adjusts to maintain a fixed current across said plurality of diodes;

providing a pre-charge current to each of said at least one column of said matrix for a pre-determined event wherein said pre-charge current is disabled after said pre-determined event;

determining a maximum voltage from all of said at least one column of said matrix, said maximum voltage being optionally used in generating said device voltage;

generating a drive current from a fixed current source and said device voltage for said each of said at least one column; and providing said drive current to said each of said at least one column after said disabling of said pre-charge current.

* * * * *